US010239090B2

(12) United States Patent
Poullos

(10) Patent No.: US 10,239,090 B2
(45) Date of Patent: Mar. 26, 2019

(54) METHOD AND APPARATUS FOR COATING A SUBSTRATE UTILIZING MULTIPLE LASERS WHILE INCREASING QUANTUM YIELD

(71) Applicant: PhotoFusion Technologies Limited, Basildon, Essex (GB)

(72) Inventor: Mark Peter Poullos, Farmers Branch, TX (US)

(73) Assignee: PHOTOFUSION TECHNOLOGIES LIMITED, Basildon, Essex (GB)

( * ) Notice: Subject to any disclaimer, the term of this patent is extended or adjusted under 35 U.S.C. 154(b) by 310 days.

(21) Appl. No.: 14/258,710

(22) Filed: Apr. 22, 2014

(65) Prior Publication Data

US 2015/0298166 A1 Oct. 22, 2015

(51) Int. Cl.
*B05D 3/06* (2006.01)
*B05D 1/12* (2006.01)

(52) U.S. Cl.
CPC ..... *B05D 3/06* (2013.01); *B05D 1/12* (2013.01); *B05D 3/067* (2013.01); *B05D 2401/32* (2013.01)

(58) Field of Classification Search
None
See application file for complete search history.

(56) References Cited

U.S. PATENT DOCUMENTS

| | | | | |
|---|---|---|---|---|
| 5,200,230 | A | 4/1993 | Poullos et al. | |
| 5,409,537 | A | 4/1995 | Poullos et al. | |
| 6,670,574 | B1 | 12/2003 | Bates et al. | |
| 7,129,438 | B2 | 10/2006 | Bates et al. | |
| 7,661,387 | B2 | 2/2010 | Poullos | |
| 7,766,213 | B2 | 8/2010 | Henrikson | |
| 2004/0230008 | A1 * | 11/2004 | Correll | C08J 3/243 525/326.2 |
| 2005/0142024 | A1 * | 6/2005 | Herzog | B29C 67/0077 419/53 |

* cited by examiner

*Primary Examiner* — Joel G Horning
(74) *Attorney, Agent, or Firm* — Welsh, Flaxman & Gitler LLC

(57) ABSTRACT

A method and an apparatus are disclosed for coating a substrate with a coating, or a coating powder. The substrate is divided into a number of target fields which are scanned by a plurality of lasers after the target fields have been pre-heated by a separate laser. A closed loop, real time servo system is employed for monitoring the coating process. Based upon monitoring of the target field, as the coating, or coating powder, is applied, real time changes to the parameters of the lasers provide for a uniform coating of the substrate.

5 Claims, 4 Drawing Sheets

METHOD AND APPARATUS FOR COATING A SUBSTRATE UTILIZING MULTIPLE LASERS WHILE INCREASING QUANTUM YIELD

BACKGROUND OF THE INVENTION

1. Field of the Invention

The present invention is directed to a method and apparatus for the application and curing of thermoplastic and thermoset coatings in situ, to a substrate, utilizing laser radiation.

2. Description of the Related Art

Utilizing lasers to heat different materials is a well-known method. For example, laser welding has been used to affix one surface to a second surface. This is accomplished by directing the output of a laser at one end of the joint in which two metal plates meet, and then scanning the laser across the joint to form a visible seam. Through the use of laser radiation, these two surfaces are fused together.

An example of using a laser for such a welding process is described in U.S. Pat. No. 7,766,213 issued to Henrikson. This patent describes a method of welding in which infrared laser radiation is employed. This patent includes a general discussion of monitoring the welding process, wherein the welder is continually illuminated with ultraviolet radiation via several sources, including laser radiation. While several techniques of monitoring the welding process are broadly described, no description is included in Henrikson, reciting a real time closed monitoring system. At best, Henrikson would use a predetermined time/power relationship and not a system in which this relationship is changed based upon the real time observation of the substrates to be welded.

U.S. Pat. Nos. 6,670,574 and 7,129,438 issued to Bates et al., are also directed to systems for utilizing a laser to weld two substrates together. The Bates et al. patents employ a computer-controlled algorithm to compare the weld to a preferred weld in a "library of algorithms", whereby the laser power and focal length of the laser are then modulated based upon the utilization of one of these algorithms. In this context, a plurality of laser welds is initially performed and the operator would then select the most suitable algorithm for the task at hand to review the sufficiency of the weld. This is accomplished by the operator running a library of algorithms associated with the weld characteristics. Similar to the Henrikson patent, the two Bates et al. patents do not utilize a real time closed system capable of changing various parameters in a real time environment.

U.S. Pat. Nos. 5,200,230 and 5,409,537 issued to Poullos et al. and U.S. Pat. No. 7,661,387 issued to Poullos, describe methods and systems for the application of fluoropolymers and other coating types via a laser in situ. However, none of these patents describe techniques and apparatuses necessary to coat and integrate multiple polymer coated fields into a uniform homogeneous coating layer. Additionally, none of these patents describe a technique to overcome the problem of controlled localized heating and processing, which is required if an entire structure to which a coating is applied cannot be simultaneously heated. Similar to the Henrikson and Bates et al. patents, none of the Poullos patents teach methodologies suitable for real time processing. Furthermore, none of these patents can adequately operate in a manner to accommodate large changes in absorption of radiated power in polymer coating materials, as well as deal with polymers having high melt viscosities.

Furthermore, none of the discussed patents disclose a technique for controlling the scan and power densities of a single laser or plurality of lasers over the entirety of a localized scan field, nor do they teach the appropriate thermal resolution and time response required for effectively coating ultraviolet (UV) curable powder coatings, thermosets, thermoplastics over various and potentially sensitive substrates.

Therefore, it is an object of the present invention is to provide a system and method for coating a substrate in a multi-functional way by changing the coating's intermolecular characteristics through the use of a plurality of lasers in a real time manner during the coating process and thereby increasing quantum yield.

It is a further object to provide a method and apparatus to adjust the power densities of the laser beam or beams used to coat the substrates in a real time manner during the coating process.

It is a further object to provide a method and apparatus employing optical and opto-mechanical devices for achieving the real time monitoring and alteration of the coating process.

SUMMARY OF THE INVENTION

These and other objects of the present invention are accomplished by utilizing a method and apparatus to provide uniform coating upon a substrate utilizing a closed system employing real time process controls. Real time process control is essential, particularly, in the use and application of high power lasers and the associated high processing temperatures, viscosities and rapid curing of various coating materials such as, but not limited to, fluoropolymers, Thermosets and UV "Rad-Cure" Coatings.

As previously described with respect to the above-discussed art, setting the power, focal length, transition speed and, the overall power density of a particular laser or lasers used to coat a substrate, was based upon a predetermined model that was purported to work under similar circumstances. As previously explained, these systems did not utilize real time processing, or address problems such as intermolecular optical scattering. However, real time processing is necessitated by the fact that small variations in both the substrate that is being coated and the composition of the coating material are capable of causing enormous swings in thermal response to high power densities associated with modern large processing lasers. In typical open loop processing of coatings, the typical thermal swings, or thermal excursions, are often as high as 300% of the targeted temperature and can have excursion times of less than 90 μs. For one to be successful in coating, cladding, or powder coating over metal substrates, the aforementioned thermal excursions must be controlled to a more acceptable tolerance. For the controlled application of powder coatings, thermal excursions in the range of 3% with less than 40 ms of dwell time are tolerated for most coatings. To achieve this goal, the laser processing of the coated material and the substrate must be controlled in real time, in a continuous closed servo loop, and not from a preselected program or menu. This is in contradistinction to the systems previously described. This closed servo loop operates in real time, allowing a more uniform coating to be applied to the substrate.

The present invention employs a closed servo loop operating in a continuous manner, allowing the coating material to be heated in a controlled and yet flexible manner. This is necessary to achieve the desired coating uniformity and integrity needed to apply conventional, as well as LW curable powder coatings, to the substrate.

The present invention teaches a method of coating by localized heating and curing of UV and conventional thermoset powder coatings parameters are controlled in a fashion that limits thermal stress to the coating, the substrate, or to both; thus allowing the localized coated areas to be combined with other immediately adjacent localized coated areas.

The present invention also allows different coatings with different spectral responses to laser radiation to be applied in an acceptable manner. Still further, the present invention describes a technique, wherein powder coating materials with high melt viscosities can be applied with a minimum amount of energy and time, which are better than the current techniques used in the curing of coatings in conventional oven systems.

The method of the present invention controls the laser radiation impinging upon a polymer surface to prevent high temperature excursions, as well as providing a heating and scanning technique that provides for even surface uniformity that increases smoothness and improves quantum yield.

These objects are accomplished utilizing a system employing various sensors to monitor the thermal signature, optical scattering of the coating and thermal footprint of a substrate as it is being coated. Initially, a visible camera would be utilized to select a target area of a substrate to be coated. Information relating to this targeted area is transmitted to a computer which would then automatically select and divide the targeted area according to a preselected computer generated scan pattern based upon the type and configuration of the substrate, the type of coating material, and the type of laser or lasers which would be utilized. Information relating to the type and configuration of the substrate, as well as the composition of the coating powder, can be manually entered into the computer. An appropriate program for operating the coating operations will be automatically generated based upon the substrate material and the type of coating being applied to the substrate.

Based upon information relating to the types of lasers employed, the substrate to be coated and the type of powder coatings to be applied to the substrate, which is entered into the system manually or automatically, a particular program is downloaded to a microcontroller which is used in the scanning process during which the coating material is fused onto the surface of the substrate. This program would include the various parameters for irradiating the coating or heating the substrate as well as the coated material to a particular temperature or temperature range, and would operate in real time utilizing a closed servo loop.

During the coating process, the thermal signature, optical scattering signature and footprint of a scanned portion of the target substrate would be monitored on a real time basis. Information relating to the thermal signature, optical scattering signature and footprint would be constantly transmitted to the computer to insure that the proper parameters of the coating process are followed. These parameters would include, but are not limited to, changing the settings of the lasers to increase or decrease the speed of the scan, as well as any power factors or densities associated with the lasers, to insure that the coating process is maintained for various parameters relating to the properties of the substrate, as well as the coating material, to insure that a uniform and homogenous coating is produced.

Other objects and advantages of the present invention will become apparent from the following detailed description when viewed in conjunction with the accompanying drawings, which set forth certain embodiments of the invention.

DESCRIPTION OF THE INVENTION

The detailed description of the present invention is disclosed herein. It should be understood that the disclosed embodiment is merely exemplary of the invention, which may be embodied in various forms. Therefore, the details disclosed herein are not to be interpreted as limiting, but merely as a basis for teaching one skilled in the art how to make and/or use the invention.

Figure 1:
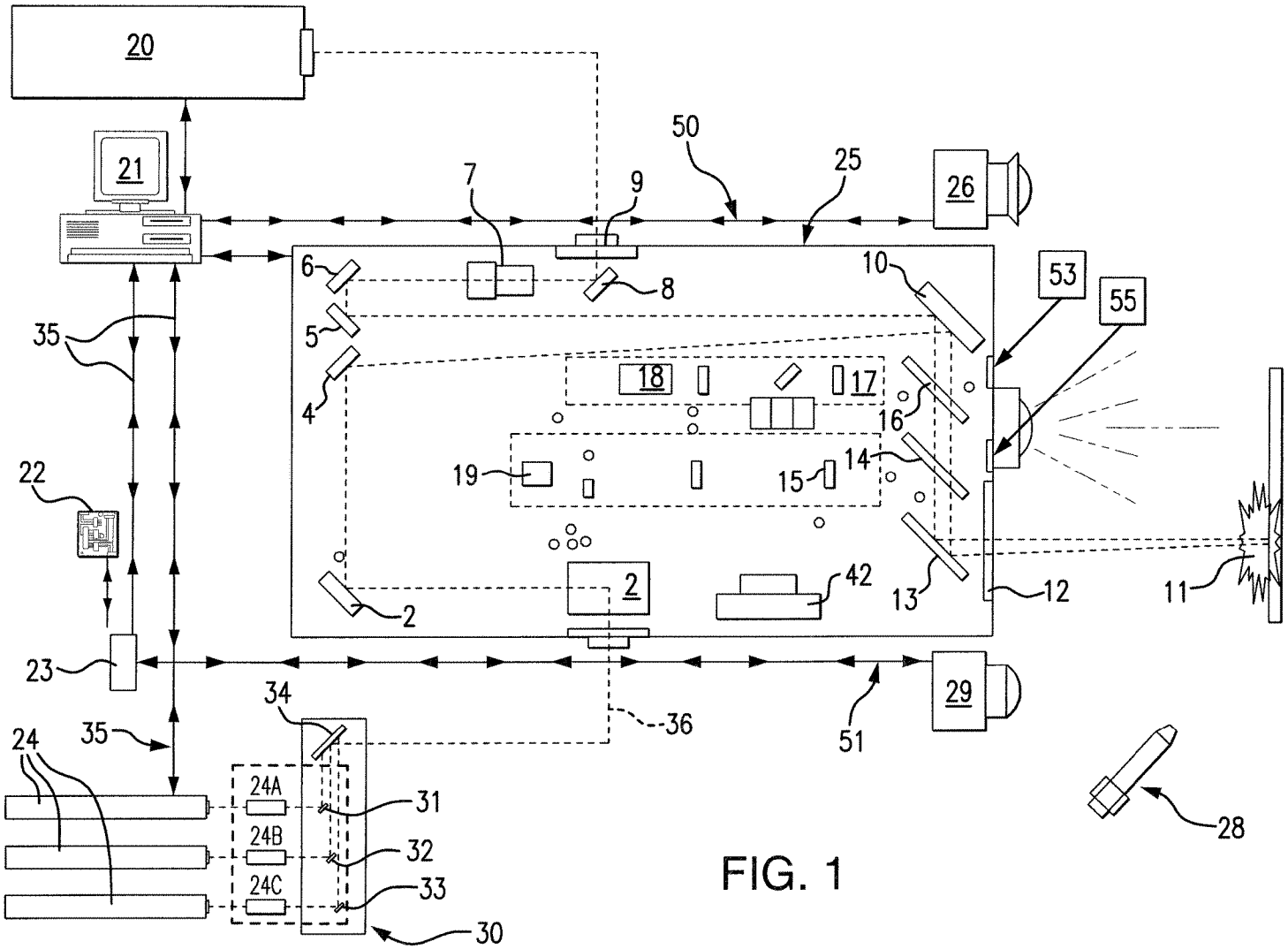
FIG. 1 is a schematic view of the apparatus of the present invention.

In accordance with the present invention, FIG. 1 shows a schematic view of the apparatus according to the present invention. As shown therein, a device 25 directs radiation produced by a large area laser 20, as well as a plurality of small spatial lasers 24 at a substrate 11 that is coated with a powder that was dispensed from a sprayer 28. As will be subsequently explained, the radiation produced by the large area laser 20 and the small spatial lasers 24 will be combined in the device 25 and directed at the substrate 11 through an outlet port 12. The device 25 also includes a telemetry monitoring system 27 including a telemetry transducer directed at the target substrate 11. The process targeting program utilizes the telemetry monitoring system 27 to assist in setting many functions of the closed loop servo system. Included in these functions are the long-wave infrared monitoring system 15, the short wave monitoring systems 17 and 18, and relevant parameters of the computer algorithm stored in the computer terminal 21. The target area, as selected by the operator, is divided up into squares or "fields" designated by the computer program. These fields vary in size according to the thickness of the metal being coated over and the coating material being applied. As a general rule, the higher the process temperature of the surface coating, the smaller the target field a designator will address. This information is transmitted to a computer 21, which is provided with a memory to store a plurality of various programs therein.

In conjunction with a microcontroller 22 and a data hub 23 in communication with the computer 21, a thermal footprint and signature of the substrate 11 is monitored in real time utilizing the information received from the primary monitoring systems 18 and 19, thereby controlling the power density within the footprint of the large area laser 20. This includes the selective use and operation of the power and selectable principle wavelength and number of the small spatial lasers 24 required. The operation of the small spatial lasers 24 are changed based upon a program stored in the microcontroller 22, used to control the curing application process of the selected coating, and the process methodology of coating the substrate 11 with a coating powder dispensed by the powder sprayer 28. An energy footprint is produced by the output of the plurality of small spatial lasers 24 being superimposed over the footprint produced by the large area laser 20. Although not shown, the operation of the powder sprayer 28 is controlled by the computer 21. The small spatial lasers 24 locally raise and control energy flux as well as temperature, and subsequent cross-linking approximating the glass transition temperature and upper thermal limit temperature of the selected powder or coating applied by the sprayer 28. This methodology also allows for control of the coating process and lends itself to real time control of the cure gradient and energy distribution with respect to a representative volume portion of the substrate 11. Concurrently, it is the function of the large area laser 20 to maintain appropriate dwell time and energy for the coatings being applied.

Utilizing FIG. 1, the operation of the present invention will be described based upon the coating of Teflon® PFA (perfluoroalkoxy resin) onto the substrate 11. It is important to note that this particular substrate coating composition is used as a typical example and other substrate coatings and compositions can be employed by the present invention. This material will be applied over a mild steel substrate and, for example, has a thickness of 9.52 mm or roughly ⅜ of an inch. Similar to the utilization of Teflon® PFA, the use of the aforementioned mild steel substrate is only one example of a substrate which can be coated. Additionally, other thicknesses of the substrate could also be utilized based upon the methodology of the present invention.

The in situ application of coating materials over large complex substrates requires many controlled parameters to be monitored and altered in order to effectively achieve the desired goals. It is absolutely essential that a closed loop real time servo control system be implemented, as will be described with respect to the drawings.

The closed loop real time servo control system maintains the proper set temperature and energy distribution of the entire substrate and the designated dimensional properties of the target field. The closed loop control function is based upon factors, such as the material composition of the substrate and the type of coating to be applied to the substrate. The coating process temperature and additional cross-linking energy requirements are selected and loaded as a set temperature and energy distribution in a closed loop control proportional-integral-derivative (PID) controller program included in the computer 21. This selected coating process temperature and energy distribution is a user identified coating parameter, chosen from a pre-established array of temperatures and energy/flux requirements entered into the computer 21 using a primary graphical user interface (GUI).

Prior to coating the mild steel substrate with a coating such as Teflon® PFA, the substrate 11 is cleaned and prepared by the removal of scale and dirt using standard practices such as, but not limited to, sanding or grit blasting. The surface preparation could also include the application of a blackening agent such as phosphating solutions. For example, to illustrate the present invention, a Caswell Industries product Black Oxide Kit (BOGK) was chosen for environmental concerns and applied according to the manufacturer's directions. After the black oxide kit was applied, the surface can again be cleaned with, for example, denatured alcohol.

The laser system of the present invention and an associated computer controlled closed loop servo control system is employed to control the coating process using a targeting program. A radiation beam produced by the large area laser 20 is introduced into the device 25 through a rotational axis inlet aperture 9. The output of each of the small spatial lasers 24 is transmitted to separate deformable thirty-two channel, sixteen bit active beam integrators/expanders 24A, 24B, or 24C. Although the small spatial lasers 24 are smaller than the large area laser 20, the size of each of the small spatial lasers is not required to be the same. The radiation beam produced by each of the integrators/expanders 24A, 24B, and 24C is directed to separate deformable adaptive mirrors 31, 32, 33 provided within a unit 30. The beams reflected from mirrors 31, 32 and 33 are combined into a single combination beam by a dichroic reflector 34 included in unit 30. The combination beam 36 is then introduced into the device 25 through articulating inlet aperture 1. The operation of the beams, produced by the large area laser 20, as well as the small spatial lasers 24, and the manner in which these beams are combined will be subsequently explained. The combination beam produced by the small spatial lasers 24, after it is inputted into the device 25 through the articulating inlet aperture 1, is directed through galvo mirror 2 to steering mirrors 3 and 4 where it will be combined with the laser beam produced by the large area laser 20 at steering mirror 10. Likewise, the beam produced by the large area laser 20 enters the device through inlet aperture 9 and is then directed by galvo-steering mirror 8 to steering mirrors 5 and 6 where it is combined with the beams of the small spatial laser beams at broad band steering mirror 10.

Once a substrate 11 is chosen to be coated, an operator would select a target area, thereon utilizing a visible field viewing camera 26 and a wide field thermal imaging camera 29 aimed at the substrate. The visible field viewing camera 26 directs a beam of visible light at the substrate used to divide the substrate into the plurality of target fields. Information received from the visible field viewing camera 26 and the wide field thermal imaging camera 29 will be transmitted on a full duplex communication data cable 50 and 51 to the computer 21. The operator can utilize a mouse to control the steering mirror 10, galvo mirror 2, and galvo-steering mirror 8, in conjunction with the visible field viewing camera 26 to allow the computer 21 to produce a designated target of interest on the substrate 11. The computer 21 is provided with a targeting program used for any target substrate. This program would automatically select and divide the targeted area according to a pre-selected computer generated scan pattern. This targeting program employs the previously described telemetry monitoring system including transducer 27 to assist in setting many functions of the closed loop servo system. These functions include, but are not limited to, the long wave infrared monitoring system 19, the short wave monitoring systems 17 and 18, and relevant parameters of the computer algorithm provided in the computer 21.

Data produced by the long wave infrared monitoring system 19 and the short wave infrared monitoring systems 17 and 18 is fed through one of the two way data communication cables 35 to the computer 21. Long wave infrared monitoring is more adept at monitoring the lower temperature of radiation as the substrate 11 is heated, as well as monitoring the amount of reflected laser energy. The short wave infrared monitor is mainly used to monitor and control cross-linking while monitoring film formation and glass transition at the target surface 11. The long wave infrared monitoring systems 19, as well as the short wave infrared monitoring systems 17 and 18, together distinguish the difference between the resulting effects on the substrate 11 by the large area laser 20 and the small spatial lasers 24.

In this specific example, the salient closed loop command components are the high speed thermal detector, the broad field thermal imager, the telemetry detector, the micro controls, and the relevant computer control algorithms.

The targeting program divides all or a portion of the substrate 11 into quadrilaterals or "fields" designated by the computer program based upon the dimensional configuration and type of material of the substrate 11, as well as the type of material to be coated, thereon to produce a targeted area. These fields vary in size according to the thickness of the material being coated as well as the coating material being applied. As a general rule, the higher the processed temperature of the surface coating, the smaller the individual field of the targeted material. For example, utilizing Teflon® PFA applied over the mild steel substrate would produce a desired target field of approximately 100 mm×100 mm or nearly 4"×4" square. These fields are distributed equally over the entirety of the targeted area.

After the initial scan is transmitted from the visible field viewing camera 26 to the computer 21 and the targeting computer program divides the substrate 11 into the appropriate target fields, the operator would then initiate a start process command in the computer 21 in which the process scan detail is illuminated with the wide field thermal imaging camera 29 projected on the target substrate 11. The telemetry monitoring system in concert with an infrared camera provided within the device 25 and the visible field viewing camera 26 is initiated and various parameters are examined by telemetry control software provided in the computer 21. These initial control parameters are looped in series with a laser and control head safety interlock system controlled from the computer 21. A continuous stream of signals which monitor both the telemetry monitoring system, as well as the large area laser 20 and the small spatial lasers 24, would prevent continued operation in the case of a computer failure, similar to a "dead man's switch". The interlock system will immediately shut the apparatus down in the event of a computer failure or if the telemetry system produces signals outside of predetermined tolerances for a particular program.

If all safety requirements are met, based upon the initial scan, an operational "GO" program is initiated by the computer 21. Individual principal elements of the system are selectively tested by the "GO" program included in the computer 21 to determine operability of the entire system. If it is determined that the system is operating properly, a preselected control program, based upon the type of substrate and the powder/coating used to coat the substrate, is downloaded from the computer 21 through data and communication cables 35 to the microcontroller 22 and the data hub 23. This control program contains multiple components, such as the long wave and short wave laser PID controller program and a mirror and optical systems control program, allowing adjustments to be made to various components of the system of the present invention. These adjustments, based upon information received from the telemetry monitoring system, including, but not limited to, target emissivity, target temperature, target topography, and surface reflectivity.

Telemetry distance from the target affects emissivity readings because of the nature of the existing optical resolution of the target. It is important that the emissivity adjustment of any target be at the same resolution for which it was originally calibrated. This information is compare to a standard black body that is an integral part of the infrared cameras. Therefore, any transmitted thermoelectric data is referenced to this standard.

The pre-selected control program would initiate a low power pre-scan, which is controlled by the microcontroller 22 and the computer 21. This pre-scan would utilize the small infrared spatial laser or lasers 24. These lasers are switched on to a low simmer power of approximately 7-10% for each of the small spatial lasers 24. The entire target field is scanned several times at a rate of approximately 150 Hz with this low power energy. The thermal signature of this low power scan produced on the substrate 11 is monitored by the infrared camera, and the relevant data is sent back to the computer 21. The data developed by the lower power scan is analyzed and becomes a computer-generated thermal map of the previously allocated complete target field. Temperature anomalies and excursions of the entire target field are monitored and noted during this programmed scan. If the temperature anomalies and excursions are within design parameters, a thermography profiling program is downloaded from the computer terminal 21 through the data and communication cables 35 to the microcontroller 22. The total energy absorption over the entire field is recorded as well and is associated spatially with the resultant temperature generated by the low power scan. This thermography profiling program contains the relevant data and parameters necessary to process the coating field in a real time manner.

Based upon a positive output of the pre-scan, the computer 21 powers up and begins the coating process by bringing the large area laser 20 online. A low-power pulse is initiated by both the large area laser 20 and the small spatial lasers 24. A power meter 53, associated with the large area laser 20, and a power meter 55, associated with the small spatial lasers 24, would measure the outgoing power produced by these lasers directed at the target substrate 11. The apparatus of the present invention locates the power meters 53 and 55 directly behind the dichroic image splitter 14 to which the combination laser beam is directed. Both the outgoing power and the thermal responses are linked by a time base, are coordinated spatially with the telemetry monitoring system, and are subsequently checked by the pre-selected thermographic control program in the computer 21. If this program indicates that all of the parameters are in a normal range, a full process command is relayed from the computer 21 over the data and communication cables 35 to the microcontroller 22. If one or more of the parameters are not in the proper range, a shutdown signal is initiated by the computer 21 and the coating process is either never initiated or is discontinued.

With the temperature profile parameters set by the thermography profiling program, the small spatial laser 24 are used to maintain the temperature equilibrium at the temperature or irradiation curing schedule and set point sensed by the telemetric thermography system or short wave monitoring systems 17, 18 illustrated in FIG. 1 of the present invention on the target field of the substrate 11. The spatial lasers 24 must have a significant dynamic range and energy flux available to produce a stable temperature within provided limits. For example, the dynamic range of the sum of the outputs of the small spatial lasers 24 is greater than or equal to 10% of the dynamic range of the large area laser 20, in order to achieve said stabile equilibrium.

Additionally, the closed servo loop also includes the programmed software residing in the microcontroller 22 after downloaded from the computer 21. This software is designed to maintain the temperature of a target field within desired control limits. These control limits are achieved through the PID program variables that include the set point (target temperature) and the difference between the set temperature and a temperature excursion. The output power KP, including the feed forward average Kff, is multiplied by the difference between the set temperature and the temperature excursion added to an error integral Ki as a time in milliseconds. To ensure process stability, the output power KP of each of the spatial lasers is recorded and averaged. The feed forward average Kff is adjusted and set to a new output power.

Figure 2:
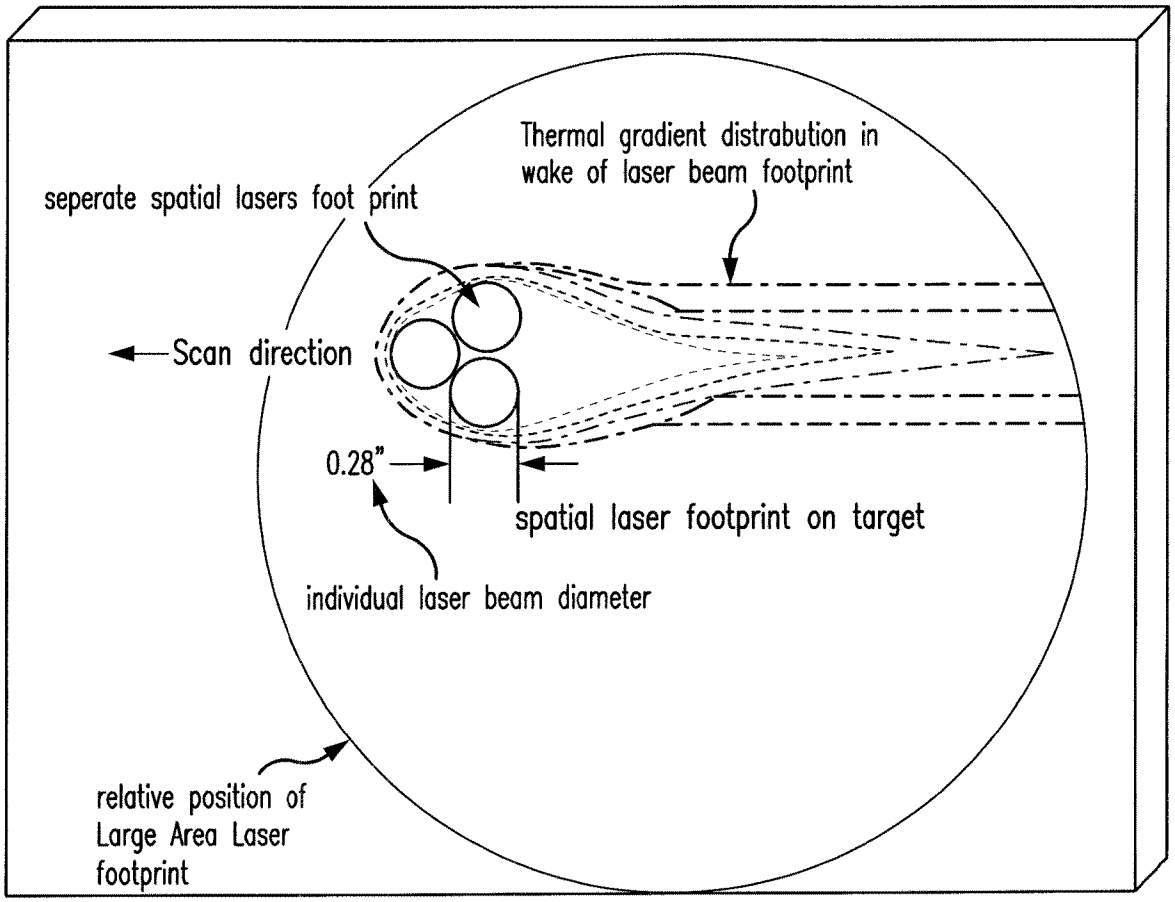
FIG. 2 is a drawing depicting the spatial laser footprint on the target substrate.
Figure 3:
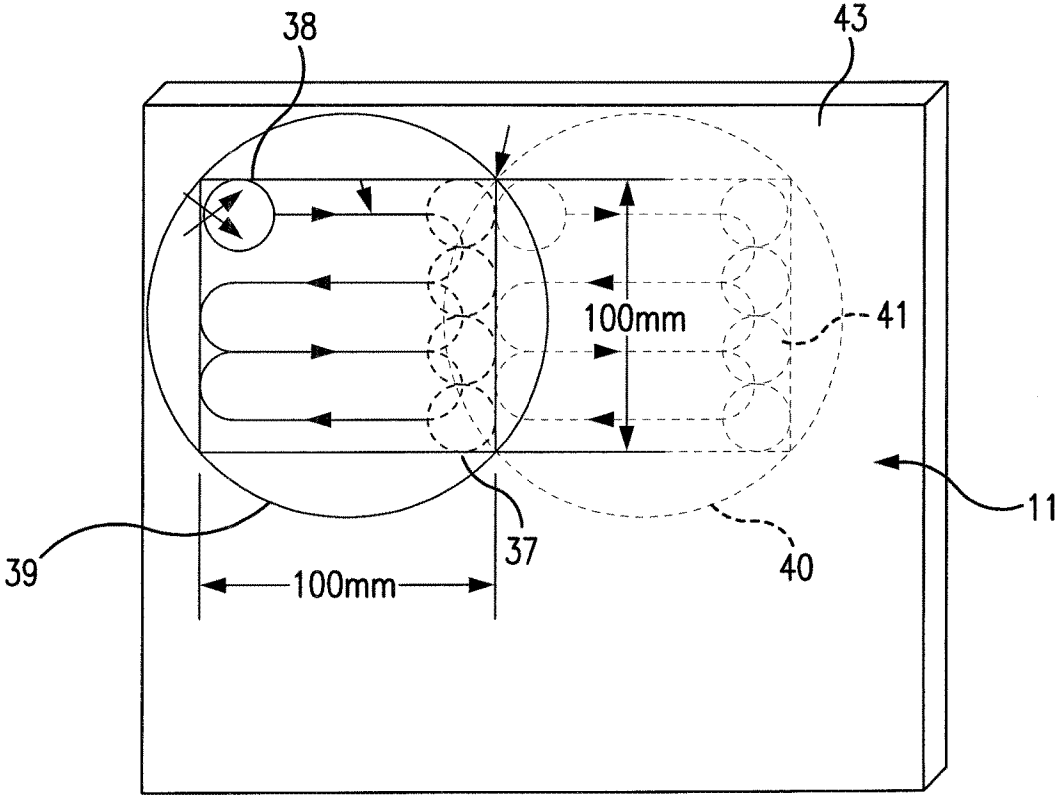
FIG. 3 is a diagram showing a typical raster scan pattern on a particular substrate.
Figure 4:
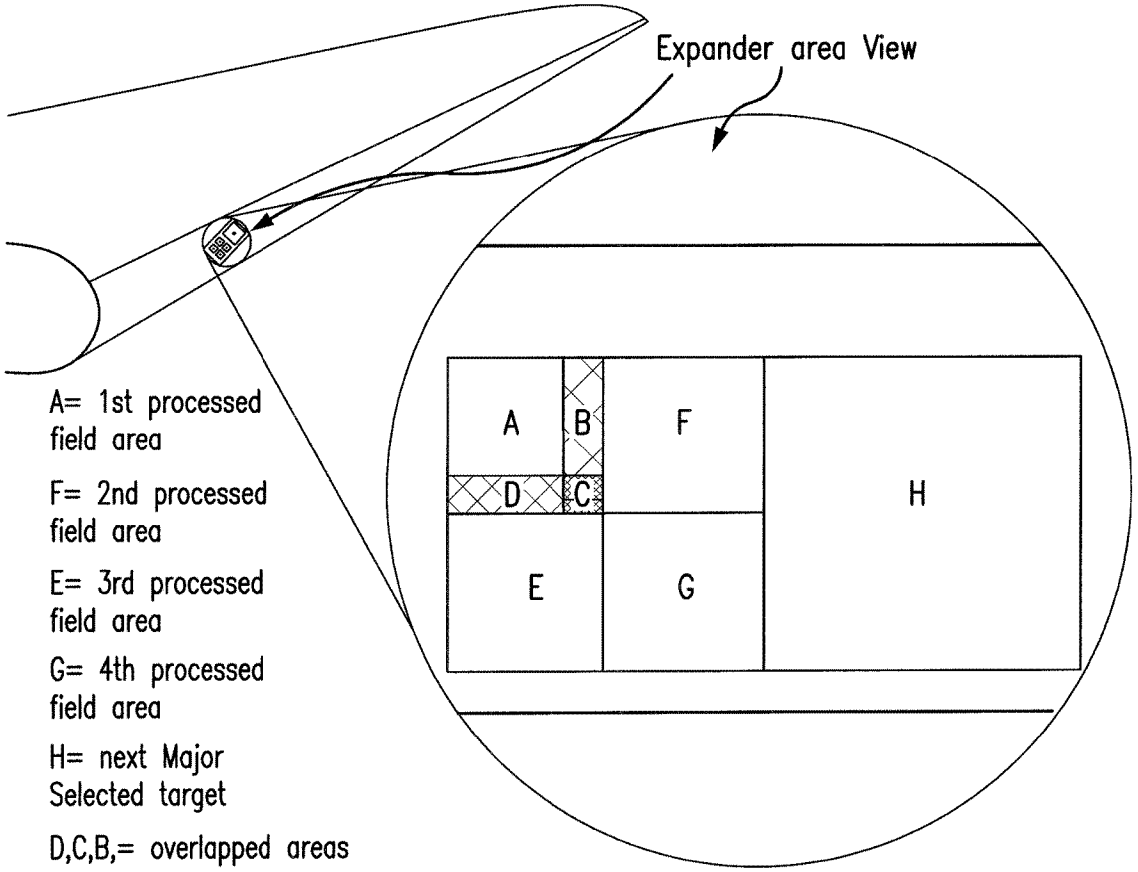
FIG. 4 is a diagram showing an expanded view of the substrate partitioned into various target areas to be coated.

During laser processing, the target is selected by the user. The target is automatically divided into several target fields that are dependent upon the total available laser power of the spatial lasers 24 and the large area laser 20. As shown in FIG. 4, the target is composed of a primary target including the combined areas A, E, F, G and, a subsequent secondary major target field, H. Area A is further subdivided into overlap areas B and D, as well as a compound overlap area C consisting of portions of areas B and D. The selected target field exposed by laser energy of the large area laser and the small spatial lasers 24 are subsequently scanned over this area to achieve the appropriate thermal and spatial resolution as shown in FIGS. 2 and 3. Additionally, the small spatial lasers 24 not only scan the initial target field, but also scan ahead in the direction of the next target field in succession using 30% of the previously recorded Kff average. The data from this scan is recorded and used to thermally characterize the next target field in succession and formulate a prediction about the characteristics of the next target field. Further, this overlap assures proper pre-heating of the coating target and substrate. Additionally, this prescan is important as the thermal data is used to control the thermal temperature gradient in the direction of the next scan field. It is important to note that the above process description pertains to all applied thermosets, thermoplastic and other thermally processed coating systems, as well as whether the target fields are coated with powder or a bare substrate, as well as whether the powder is cured or not. The important differences between the thermoset coatings, thermoplastic coatings and other thermally processed coatings pertain to the PID control and the temporal control of the field perimeter. In the case of thermoset coatings, both temperature and time of laser exposure are tapered outward from the field perimeter edge to no more than 30% of the entire area of the adjacent field. This controlled tapering should limit cross-linking to no more than 47% of the available cross-linking terminals of the adjacent thermoset powder coating. This power tapering would utilize a separate program designed to reduce and taper the Kff setting in the PID loop. The present invention controls the melt flow rheology and cross-link tapering at the edge of the coated fields in order to ensure proper coating continuity and to prevent coating failure between adjacent fields.

In addition to tapered cross-linking, this process is absolutely essential to preventing premature, uncontrolled melt flow rheology of the uncured powder and coating. As temperatures directly affect melting, melt viscosity, melt flow rheology and surface drying/curing a controlled taper is absolutely essential. The temperature control gradient is dependent on the type of coating and its related melt flow viscosity. Because all radiation cured coatings cure from the outside towards the substrate, heating of the outside surface lowers the melt viscosity at the surface first. This means that if the over temperature gradient is not limited and the melt viscosity of the coating is unintentionally lowered outside of the control gradient parameters, uncontrolled melt flow will occur. Rapid Melt Flow at the coatings surface lowers the surface tension of the melted polymer. This melting polymer is in contact with the cold substrate rapidly cools causing a rapid change in surface tension. It is important to understand this type of uncontrolled melt flow often leads to the lowering of the polymer surface tension causing the coating surface to coalesce into small spheres on the cold substrate. This of course is severely detrimental to coating formation and quality.

Once the coating process program is initiated, the laser power is increased to the large area laser 20 to at or near full power, thereby heating an initial target field on the target substrate 11 to the lower processing temperature of the particular coating substance. A focal plane array (FPA) including the long wave infrared monitoring system 19 in communication with the long wave infrared monitoring system 15, as well as the wide field thermal imaging camera 29 monitors the rising temperature of that initial target field in real time. The beam produced by the large area laser 20, as previously described, would enter the device 25 at inlet aperture 9 and would be directed through a galvo-steering mirror 8 to a variable beam expander 7. The beam produced by the variable beam expander 7 would then be transmitted to beam fast steering mirror 5, and steering mirrors 6 and 10, and dichroic 16, to dichroic image splitter 14, and then to a fast steering mirror 13, which directs the beam produced by the large area laser 20 as well as the small spatial lasers 24 to the target area on the substrate 11. Due to the extraneous temperature produced by electronics and by optical absorption attributed by the laser beams created by the large area laser 20 and the small spatial lasers 24, a radiator fan 42, provided in the device 25 and controlled through the computer 21, will control the temperature within the device 25. Cooling water would also circulate within the device 25 in proximity to mirrors 13 and 16, as well as the image splitter 14.

Based upon the information provided by the FPA and the wide field thermal imaging camera 29, the variable beam expander 7 is adjusted to expand or lower the large area laser beam to a predetermined power density. This power density is monitored by a closed loop command servo which is observed and verified by the FPA, the short wave monitoring system 18, and the wide field thermal imaging camera 29.

As previously described, the temperature of the substrate 11 should be elevated to or near the preferred lower melt point of the coating substance by the large area laser 20. The small spatial laser or lasers 24 would then be used to elevate the temperature to or slightly below the upper melt point and glass transition temperature of the coating powder. This process would further maintain temperature uniformity and general distribution critical to overcoming thermal expansion issues, as well as melt dwell time required by high melt viscosity low polymers such as Teflon® PFA, once the power density of the large area laser 20 is stabilized, occurring usually within a few milliseconds from the time that the beam produced by the large area laser 20 is directed at a target field of the substrate 11. Simultaneously, galvo mirrors 2, beam steering mirrors 3 and 4, as well as the fast steering mirror 13 are energized to maintain proper alignment with the target substrate 11 and controlled by the predetermined scan program sent to the microcontroller 22 from the computer 21. The beam steering mirrors 3, 4, 6, 10 and dichroic 16, are specifically included to maintain and control the alignment of the system with the substrate. Once the system has been properly aligned initially with respect to the target, it would remain that way. Anytime the apparatus starts to operate, a re-alignment of the mirrors is automatic. The fast steering mirror 13 is a single element mirror that will precisely reposition the laser pattern generated by the galvo mirror 2 to a selected position on the target. The real time closed loop servo control system, via the PID master control program, monitors and modulates the power of the small spatial laser or lasers 24,*a,b,c*. The spatial laser beam energy footprint, as illustrated in FIG. 2, as well as the relative beam size produced by each of the small spatial lasers 24 on the target substrate 11, which is critical to the integrity and control of the overall application parameters.

Although FIG. 1 shows the use of three small spatial lasers 24, more or less small spatial lasers can be employed. In general, many variables must be considered to determine the proper number of small spatial lasers to be employed. For instance, the smallest relevant thermal resolution point on the target substrate 11 is determined by the beam footprint of the smallest spatial laser. The power density may reach a critical temperature, such as the upper processing temperature or the dissolution transition temperature, more quickly on a relatively small beam footprint than a large beam, since as the diameter of the laser footprint doubles; the power density becomes a quarter of the original. Therefore, it may be necessary to use multiple small lasers to cover the same area quickly and efficiently. The determining factor of the number of small spatial lasers is how quickly the powder coating on the surface of the substrate transmits the laser energy to thermal energy conducting through the body of the coating and to the substrate surface. Another determining factor is that there is enough short wave laser energy to cross-link and cure out radiation curable coatings. Further, the small spatial lasers 24 can be of differing wavelengths depending on the required curing mechanism of the coating such as with the use of UV lasers on UV coatings. It is this distribution that accentuates Brillouin scattering while increasing the probability of Photon-Phonon scattering, as well as Photon-magnon scattering and distribution of quasiparticles. Brillouin scattering increases photo-electric optical penetration of the coating by laser energy. Additionally, low thermal coating conductivity may result in burning on or sublimation of the material before it transitions to the melted state or glass transition point. Another consideration of significance is the complexity of the variations of the surface topography. In order to integrate sufficiently a surface of complex topographical complexity the use of multiple spatial lasers is employed to assure precise point integration of power. This fact is primarily used to control the quality of the available spatial resolution.

The small spatial laser beams are equipped with 16 bit active beam integrators/expanders 24A, 24B, and 24C. They are adjusted to maintain optimal beam size, beam shape, and power density necessary to maintain coating uniformity and spatial resolution of the scanning of a first target field 37, as illustrated in FIG. 3, wherein the small spatial laser footprint 38 is scanned across the first target field 37. As can be appreciated, the smallest thermally controlled area of the first target field 37 is determined by the size of the small spatial laser beam footprint on a target surface as shown at 38. Each of the active beam integrators/expanders 24A, 24B, and 24C, in concert with deformable adaptive mirrors 31, 32 and 33, is an optical element that is flexible with small piezo actuators on its back surface that manipulate the flexible element. This allows for the output beam to be re-imaged in multiple independent facets over a given area.

The 16 bit active optics, allow very precise, high resolution and real time energy control distribution and beam integration. This is important to the process, especially when associated with target surfaces of varying topography and geometry. For example, with respect to the application of Teflon® PFA, the small spatial lasers only control the upper limit temperature, as well as the accumulative thermal dwell time necessary to achieve the surface uniformity and smoothness. The large area laser footprint 39 is slightly greater than the first target field 37 and is constantly maintained on the first target field 37 throughout the raster scan pattern of the small spatial laser footprint 38 as it scans the entire first target field 37. As previously indicated, the large area laser 20 is used to initially heat the first target field 37 to the lower processing temperature.

The thermal small spatial laser footprint 38 is monitored by the FPA, which includes the long wave infrared monitoring system 15. For example, the FPA is a large array INSB FPA detector or the equivalent. Monitoring of the thermal small spatial laser footprint 38 of the small spatial lasers 24 is coaxially aligned with the spatial laser footprint via the dichroic window/beam splitter 14, as well as the fast steering mirror 13 shown in FIG. 1. As both the power from the large area laser 20, as well as the small spatial lasers 24, are applied to the target substrate 11. The long wave infrared monitoring system 19 of the FPA is used to examine the thermal signature in relation to the scan direction.

The properties of the temperature delta of the scan footprint are monitored in the region immediately preceding the direction of the scan to that of the immediate temperature in the post scan footprint. This feature is illustrated in FIG. 2 showing the scan distribution created by the small spatial lasers 24. As illustrated therein, three separate spatial lasers are shown, each laser producing its own thermal distribution in the wake of the laser beam footprint. Additionally, it is noted that the various dotted lines of the thermal distribution, shown in FIG. 2, represents 10° C. changes in the thermal gradient. As illustrated therein, the diameter of each individual laser beam is 0.28 inches. However, as can be appreciated, based upon the type of substrate 11 to be coated, as well as the coating material, this laser beam diameter can be increased or decreased.

The liquid-glass transition, or glass transition for short, is the reversible transition in amorphous materials (or in amorphous regions with semi-crystalline materials) from a hard and relatively brittle state into a molten or rubber-like state. An amorphous solid that exhibits a glass transition is called a glass.

Despite the massive change in the physical properties of a material through its glass transition, the transition is not itself a phase transition of any kind; rather, it is a laboratory phenomenon extending over a range of temperature and defined by one of several conventions. Such conventions include a constant cooling rate (20K/min) and a viscosity threshold of 10 Pas, among others. Upon cooling or heating through this glass transition range, the material also exhibits a smooth step in the thermal expansion coefficient and in the specific heat, with the location of these effects again being dependent on the history of the material. This phenomenon is characterized for control purposes by using a DSC. (Digital Scanning calorimeter). However, the question of whether some phase transition underlies the glass transition is a matter of continuing research.

Returning to the example of utilizing Teflon® PFA applied by the lasers over a metal substrate 9.52 mm thick with a coating density of 9 grams per square centimeter per coating layer, an upper processing temperature of 308° C. is desired. The large area laser 20 initially heats the large area laser footprint 39 in FIG. 3 to the lower processing temperature of 338° C. This temperature is maintained over that large area laser footprint for a minimum of 9.8 seconds. During this time, the small spatial laser footprint 38 produces a temperature never to exceed 338° C. (the upper processing temperature) as it scans the target field 37. The average power density as applied by the small spatial lasers 24 can be approximately 1.366 J/mm$^2$. The automated powder sprayer 28 is energized at the time that the large area laser 20 heats the entire large area laser footprint 39 and as the small spatial lasers 24 move across the target field 37 as shown by the raster scan pattern illustrated in FIG. 3. This procedure is done to facilitate "hot flocking". "Hot flocking" yields a relatively high thickness of coating layers necessary for the application and use of fluoropolymers in the chemical processing industry. Further this "hot flocking" technique may also be used to produce 3-dimensional additive manufactured surface features. This process is repeated and monitored by the program stored in the microcontroller 22 via the closed loop servo system and the PID loop. The telemetry monitoring system constantly measures the thickness of the coating and continues the process until a predetermined thickness or shape is produced. It is noted that depending upon whether the coating is thermoset or thermoplastic, as well as the coating and the composition of the substrate 11, the powder might be sprayed onto the substrate after it has been pre-heated and/or before it is heated and then fused in place, particularly if a primer is applied to the substrate. The direction of the sprayed powder may change with respect to the position of the laser beams, either before or after the application of the laser to the substrate.

The application of powder coatings, such as Teflon® PFA coating is done in successive thin coatings of approximately 87 grams per square meter. This is necessitated based upon the relative absorption at the spectral wavelength of the laser which is utilized. Typically, the higher the absorption of laser radiation by the coating layer, the thinner the layer that must be applied during each scan. This is important since the powder coating layer lies in the path of the laser radiation, and therefore must conduct a substantial amount of energy that is absorbed to the substrate 11 in order to effect a fusing of the powder coating layer to the substrate. An increase in the thickness of the uncured/un-fused coated layer will only slow the coating process or, in the worst case, absorb a disproportionate level of laser power, and therefore cause the coating material to overheat. Therefore, it is important that the large area laser 20, as well as the small spatial lasers 24, be used to preheat the targeted field area 37 to the upper processing temperature or slightly below the upper processing temperature of the polymer to be coated. After this temperature has been achieved, the powder coating layer is then applied. This will cause the powder coating layer to immediately fuse and melt to the substrate upon contact. This process as previously indicated is known as "hot flocking" and may be repeated multiple times over the targeted field area 37 to achieve the desired coating thickness or shape.

Although different types of lasers can be utilized with fluoropolymers, such as non-pigmented Teflon®, it has been found that the process, according to the present invention, is improved if the large area laser 20 is a $CO_2$ laser and the small spatial lasers 24 are YAG or Ytterbium Fiber Lasers. As one example, the $CO_2$ large area laser 20 has a principal wavelength of 10.6 μm. This wavelength is in the far infrared spectrum as related to the visible wavelength. At this wavelength, Teflon® PFA will absorb the laser radiation at nearly 48% to 49% of the power density. This fact was confirmed using a Nicollette® FT IR spectrograph. This spectrograph was performed on a uniform Teflon® PFA film and not used on un-fused powder coatings. The absorption of the laser radiation of the $CO_2$ laser on un-fused Teflon® PFA powder coating is greater. This is the reason one would experience a greater and faster temperature rise in virgin powder than one would experience in a fused polymer layer. This condition is further exacerbated when using lasers of shorter principal wavelengths than the principal wavelengths of the $CO_2$ laser herein described. Tests were conducted with ND Yag of 1064 nm and Ytterbium Fiber lasers of 1070 nm wavelength and a diode laser pack of 808 nm wavelength. These laser systems produce good results, but required a greater degree of power density control and thermal resolution. For example, the ND YAG laser power density of 0.89 J/mm$^2$ on virgin powder would produce a rapid rise in temperature greater than that of the $CO_2$ laser. Once the coating reached the glass transition temperature and began to fuse, the fused powder coating became much more transmissive to the YAG laser radiation than that of the previously described $CO_2$ laser. It is this fact that causes larger temperature swings in these types of coatings than experienced by the application of laser radiation having a principal wavelength of 10.6 μm for the $CO_2$ laser.

It has been found that optimum speed and performance is produced using the multi-laser processing of fluoropolymer coatings employing the large area laser 20, as well as the plurality of small spatial YAG or Ytterbium Fiber Lasers 24. In this example, the large area $CO_2$ laser 20 heats the polymer coating and a substrate during "hot-flocking" until the temperature is at or slightly above the glass transition or lower processing temperature. After the glass transition temperature has been reached, the overlapping scan of the target field 37 is performed by the small spatial YAG or Ytterbium Fiber Lasers, lasers 24. The scan is a standard raster scan overlapped within the thermal footprint of the large area laser 20. This technique provides much greater control and thermal distribution for both the polymer and immediately adjacent fields, such as a second target field 41 within an adjacent large area laser footprint 43. The highest thermal resolution using the present technique is governed by the individual laser footprints on the target substrate 11. The thermal footprint on the substrate is controlled by the small spatial lasers 24 with deformable 32 channel 16 bit active beam integrators/expanders 24A, 24B and 24C and including mirrors 31, 32, and 33.

As previously described, the present invention provides a thermoset coating in multiples of thin layers. Since the laser system cures the coating in multiple segments and/or fields that are joined to each other, it is necessary to cure thermoset coatings in a manner in which the coatings adjacent to one another can also cross-link with each other to form a unified uni-dimensional coating that has uniform properties across the adjacent layers.

In this example, when a thermoset coating is applied, computer generated lattices of fields are subscribed over the entire area to be coated. Each target field is approximately 100 mm×100 mm in size, with the large area laser covering an area slightly greater than 100 mm×100 mm in size. The pattern produced by the large area laser is generally round with a power density exhibited by a semi-Gaussian beam profile. This Gaussian beam profile has its greatest power at or near the majority of the central region of the target field. The remaining power is tapered out towards its edge, providing a thermal gradient that is acceptable for processing thermoset materials. The spatial application of the small area lasers is also critical to properly coat the substrate. The temperature within the target field must be at or above the critical temperature, allowing the thermoset material to melt and flow to achieve sufficient dwell time in order to allow the polymer's coating to completely cross-link. It is also critical that the large area laser completely covers the target field, thereby restricting temperature excursions above the critical cross-linked temperature, such that the adjacent target fields may be cross-linked together when they are subsequently processed at or above the critical cross-linked temperature. If for some reason the entirety of the large laser footprint was unintentionally cross-linked throughout the entirety of the footprint area, the immediately adjacent target field coating would not be sufficiently co-cross-linked together to form one uniform coating over the entire substrate. If this would occur, the adjacent coated target fields that were not cross-linked together would fracture due to thermal stress and the coating would fail along the line between the adjacent coated target fields.

As described with respect to FIG. 3, the thermoset coating is applied initially to a single first target field 37 having a size determined by one of the computer programs provided in the computer 21. As shown in FIG. 3, an example of Teflon® PFA in the target field 37 is a square of approximately 100 mm. This first target field 37 is encompassed by a slightly larger large area laser footprint 39. The pattern produced by the large area laser 20 is round by its nature with the power density exhibited by a semi-Gaussian beam profile. This semi-Gaussian beam profile has the highest projected power at or near the central region of the target field 37. The remaining power is tapered out toward the edge, providing a thermal gradient that is acceptable for processing thermoset materials. As in the case of thermoset coatings the temperature within the target field 37 must be at or above the critical temperature wherein the thermoset material melts, flows, and achieves sufficient dwell time in order that the polymer's coating is completely cross-linked.

It is also critical that the large area laser footprint 39 completely encompasses the small first target field 37, thereby restricting temperature excursions above the critical cross-linked temperature, such that adjacent coating fields may be cross-linked together when they are subsequently processed at or above the critical cross-linked temperature. If for some reason the entirety of the large area laser footprint 39 was accidentally cross-linked throughout the entirety of this area, the immediately adjacent coating field would not be sufficiently co-cross-linked together to form one singular uniform coating over the entirety of the substrate 11. In fact, if this were to occur, the adjacent coating fields that were not cross-linked together would likely fracture due to thermal stress and the coating would fail along the line between the two adjacent target fields 37 and 43. It has been shown that overlapping by the larger area laser must not cause cross-linking at or above 60% of the available cross-link terminals. This allows 40% of the adjacent cross-linked terminals to be cross-linked with the adjacent coating field, thereby forming a uniform cross-link across the entirety of the coated object. This process is applicable to both thermoset coatings as well as UV curable coatings.

During the application of the powdered material to the first target field 37, once the small spatial lasers 24 begin the raster scan pattern as illustrated in FIG. 3, each scanning of the first target field 37 would produce a thin coating. The scan is repeated multiple times to perform an over-scan until it has been determined that the proper thickness over the substrate 11 of the coating material has been applied. At this point, the scan of the first target field 37 ceases. The computer 21 would then focus the large area laser 20 on the second target field 41 to preheat this area to the lower processing temperature of the coating powder. As shown in FIG. 3, the large area laser 20 will heat target field 40 which includes the second target field 41. Once the second target field 41 reaches the lower processing temperature, the second target field 41 will be scanned using the small spatial lasers 24 as previously described. In this context, it is important that the individual target fields 37 and 41 must be integrated as to form a continuous smooth pinhole free coating over the entirety of all or at least a portion of the substrate 11. Each individual field and layer must be processed by progressively overlapping with a minimum overlap of 3% at the edges of the coating field or between layers. This is done to avoid thermal stress risers or non-adhesion occurring in the vicinity of the adjacent coating fields. As each individual coating field is processed, there is a tendency of the process coating to shrink toward the center of its mass as the coating cools from the upper melt or cured temperatures. This shrinking imposes strong mechanical stress on the edges of the individual coating field. Therefore, after multiple adjoining coating fields are applied, it is often necessary to over-scan the entirety of the coating, overlapping the perimeter and into adjoining adjacent fields to normalize this thermal stress. This task is accomplished by using the large area laser 20, as well as the small spatial lasers 24, to over-scan these areas and bring them to their critical annealing temperature for a minimum dwell time. It should be understood that powder coatings with lower melt viscosities will require shorter dwell times as they tend to melt flow much easier. This will alleviate the mechanical stresses on these adjoining fields. In the case of thermally cured coatings, it is necessary to prevent the adjoining edges from complete curing until the next field has been applied. Once the adjacent field or layer is applied, the adjoining edge of the field or layer may be cured.

With the exception of the small spatial lasers 24, the large area laser 20, the computer terminal 21, the microcontroller 22, the data hub 23 and the automated sprayer 28, all of the control apparatus is contained in the device 25. Since the present invention is designed to be mounted upon a robotic arm with its axis of rotation about the central axis of the inlet apertures 1 and 9, it is important that the device 25 be as light as possible. The device 25 serves the very important function of simplifying complex geometric coating applications. The majority of these applications are limited to line-of-sight, except when thermal saturation of the target substrate can be accommodated. An essential feature of this design allows very complex surface topography to be coated and controlled without the requirement of complex robotic control maneuvering. The design of the present invention simplifies the robotic design and allows for much greater processing regions without frequent repositioning or restaging. The present invention also allows large areas to be coated at a time, as well as increasing system utilization, power management and efficiency. This allows for greater control over adjacent target fields for the purpose of controlling expansion and coating integration.

It is a further objective of this invention to solve problems associated with UV Radiation curable coatings principally among these problems are:

a. Pigment sensitivity
b. Oxygen inhibition
c. Total dft. (Dry film thickness) after cure
d. Formulation dependence on available UV light sources; spectra and intensity.
e. UV penetration into coating.

Another important development associated with the use of multiple lasers for thermal processing relates to the nature of the coatings themselves. Most current technologies of powder coatings include coatings that, unlike thermoplastics, are cured by utilizing ultraviolet light, for example. The present invention utilizes multiple lasers from the infrared to UV spectrum. The use of multiple lasers allows very broad application flexibility, as well as coping with a multitude of coating processing requirements and available chemistries for a particular level of coating performance. An example of this is the use of UV powder coatings that are cured thermally with the infrared laser system and then subsequently cross-linked by the use of the UV laser. Multiple frequencies in the UV spectrum are often desired in order to achieve the best cross-linked cure of the coating, as well as maximizing coating film penetration and photo-electric coupling. The spectral range for UV is from approximately 126 nm to approximately 400 nm. The curing and processing of thermoset powder coatings generally demand the use and the correct application of multiple lasers. The peculiarity of Processing UV coatings with laser systems is described here. It is desirable to process UV curable coatings for a myriad of reasons disclosed in the following. Careful note is directed towards the fundamental processing differences for chemistry variations between UV Powder coatings, UV hybrid cross-linked powder coatings, and UV Liquid system coatings. We will begin with UV Powder coatings. Previously in this document, a description of the thermoset powder coatings process was described. The process of curing UV curable powders is very similar to that of a thermoset or thermoplastic, with the major difference in the cure/cross-linking method. Thermosets typically contain TGIC (triglyceride isocyanate) or beta-hydroxy alkyl amide, which are the most prevalent cross-linking agents in thermosets. The exception is that UV Hybrid coatings contain both thermoset cross-linking chemistries and UV curable coating chemistries. Thermoset and UV photoinitiators, such as (AHK) alpha-hydroxy ketone or (BAPO) bis-acylphosphine oxide and cross-linking compounds, such as M-1530, hexahydro-1,3,5,-tris(1-oxo-2-propenyl1)-1,3,5,-triazine (1,3,5,-triacryloil-hexyhydro-triazine), PSG (pentaspiroglycol diallylether), and Zn diacrylate, are utilized in UV curable and UV hybrid powder coatings in various amounts, depending on melt-flow rheology and film surface curing performance quality desired. It is the intent of this author to obviate the interactions of light and its effect on the curing of these complex materials and the complex coating compounds they form. In UV-curable and UV hybrid powder coatings, traditionally the powder is electrostatically applied to the substrate and then processed at temperatures from 80 to 140° C., just long enough to achieve the degree of melt flow required. The molten coating is then cured under UV light while at an elevated temperature. In contradistinction, to coating formulations described previously in this text, these conventional powder coatings that require temperatures from 180 to 200° C. for extended time frames to bring about the cross-linking reaction, which sets in before the surface flow has completely finished. This phenomenon causes significant surface quality issues with thermoset powder coatings, such as orange peel. It is also difficult to apply these coatings on substrates that are thermally sensitive, such as composite materials. It is important to understand the limitations of conventional UV curing with lamps as compared to UV curing with lasers. Additionally, the UV laser light interaction is presented to enhance the understanding of the methodology of this text. As mentioned earlier, multiple lasers are used in conjunction with this system in order to produce the desired results. For curing UV coatings with UV A, UV B, and UV C energy, the selected combined wavelengths are as follows: 266 nm, 355 nm, 365 nm, 405 nm, and 445 nm. These specific wavelengths are far enough apart to be combined in a single fiber where desired. At first glance, the use of multiple lasers seems predicated on the hopes of randomly hitting the relevant frequency necessary to couple cross-linking agents and photoinitiators. However, the use of these chosen wavelengths has to do with the factors and phenomena resident in processing UV curable coatings and increasing the probability of Brillouin scattering. These factors include, but are not limited to, surface cure qualities, oxygen inhibition, UV energy penetration in pigments, and depth of penetration. Other ultra violet considerations designed into this system and in combination with the long wavelength lasers previously described in this text, are utilized to process a broad spectrum of powder coatings and liquid formulations. Laser processing of coatings should not be confused with absorption, as with fluorescence, where the compound/molecule is excited to a discrete (not virtual) energy level. The majority of photoelectric energy transfers described here is geared toward improving virtual photon particle interactions, and therefore absorption. In particular the most salient points for this technique are listed below:

1. Raman scattering
2. Anti-Stokes Raman scattering
3. Stokes Raman scattering
4. Rayleigh scattering
5. Equipartition of energy
6. Gibbs free energy
7. Brillouin scattering
8. Elastic scattering
9. Inelastic scattering
10. Refractive Index and changes in Refractive Index
11. System entropy
12. Polymerization changes
13. Coating thickness
14. Coating pigmentation
15. Coating chemistry-reaction All current UV curable coatings chemistries have similar interaction qualities as that of UV curable powder coatings. For brevity, we will focus on UV curable powder coatings. A description of the relative intensities of the light and specular reflection scattering, absorption, and transmission through a pigmented coating is described. The methodology for determining the relative values of the interaction of light is described and is a common practice in determining specific light interaction values. The recorded data is used to formulate and characterize the control algorithms for computer processing of laser material interactions This invention solves problems associated the application of multiple coating layers of differing pigmentation and composition without cross curing or adhering said layers immediately adjacent to one another. Further, this process lends itself to clear demarcation between layers, eliminating the need for stencils, photomask, or masking tapes. Laser processing, as described, is the only method to process adjacent coatings in near proximity without cross-linking interference. Every person that has painted a car, boat, or airplane, is all too aware of the need to carefully mask off coatings with different pigments to be able to produce straight lines. This can be seen on any car with a two tone color scheme. Conventional methods require the coatings applicator to first apply a base coat of a particular color. After the base coat is fully cured, then the applicator proceeds to mark of the surface of the coated object and apply masking tape with a straight line that borders precisely the area intersected between two colors. With this instant invention, this prior technique is obsolete.

An example of this process is described below. A thin aluminum sample plate made from 2024-T3 aircraft grade aluminum was tested. The dimensions of the sample plate was approximately 650 mm×450 mm wide This plate was completely coated with a UV curable, low temperature cure, base coat, grey powder coating, sprayed, and cured with the laser methodology described earlier in this text. Additionally, a UV curable powder coating pigmented red top coat was applied on the bottom half. No attempt was made to mask the lower red half from the upper grey half. A fiber laser operating in the pulse mode was scanned across the center region of the sample plate at a pulse frequency of 3 KHz and a specific energy of 19 J/mm the principle lasing wavelength the beam was condensed down to 4 mm. This beam was scanned across the central region with an overlapped scan on the sample plate seven separate times, creating an ablated path of about 22 mm wide, leaving the majority of uncured red powder on the lower half of the aluminum plate with even less uncured red powder above the 22 mm ablated line. The width of this line is predicated by the thermal conductivity of the substrate. In general the width of the ablated line should be wider than maximum distributed thermal gradient that lies at or below the melt flow or cure temperature of the uncured coating. There are several important factors that determine the minimum width of this line. One is the maximum processing temperature of the coating during the curing stage. The second factor is the total thermal mass of the cured coatings that lies upon the metal substrate. The third factor is the thermal conductivity of the metal substrate. The final factor is the latent heat of the powder condensing to a coated film must also be considered. As there is a plethora of coating powders available with a significant difference in cure temperatures, a determination can be easily made using a thermographic infrared camera or non-contact type of temperature sensor. A sample plate was coated to test the minimum (thermal margin) requirement for laser masking. This is accomplished by applying a powder coating on a metal sample plate with the same material and thickness of the actual structural coating to be masked. The powder coating, in this case, is applied on the metal substrate and the actual use of masking tape is applied at the full width of the sample plate at, and about its center. After the powder coating is applied, the masking tape is removed. The powder coating with a cure temperature of 128° C. is processed with the laser system described above and careful note of the thermal gradient is observed. In particular, the maximum extent of the temperature gradient at, or above 128° C. is observed and the distance traveled by thermal conduction through the metal substrate is noted. This distance is multiplied by a minimum safety factor of approximately 15 percent of the maximum extent. This, now, gives the total distance needed to predict the width of the ablated line as described above. In the case of the UV Curable powder, this distance was 19 mm in width with an additional 15 percent margin added, bringing the total ablated width to 22 mm. The lower red half was laser fused as described earlier, with the lower melt point set at 109° C. (large area laser) and the upper temperature limit set at 126° C. (small control laser). Subsequently, the grouped UV laser array is scanned over only the red lower half with the LTV laser system while above the glass transition temperature; precisely as not to cross the 22 mm ablated line. Prior to the sample plate cooling to room temperature, the remaining red overspray powder is blown away by a jet of air as it is easily removed from the surface. The aluminum sample plate now has two different pigmented colors, red over a grey base, with a sharp linear delineation between them without having used masking tape our stencil to separate the two colors. This technique is highly advantageous to curing coated materials in near or adjacent proximity. This technique surpasses earlier attempts with thermoset materials, as it is not easily affected by conducted radiant energy in the metal substrate causing coatings to crosslink and stick in unwanted, unmasked areas.

In addition to multiple pigmented areas applied adjacent to each other forming, letters, placards, decals, and logos. UV cured and ablated 2-D coatings can be stacked one atop the other, in a specific pattern to form 3-dimensional shapes in the surface of the coating. These 3-D shapes can be used to produce additive manufactured precision aerodynamic features, such as Vortex Generators (VG's), large eddy break up units LEBU's, dimples, riblets, and other aerodynamic features. Precise control is afforded by the laser coating process to produce coated surface qualities and efficiencies the likes that will make several desirable properties possible. One of the aforementioned desirable qualities occurs when powder coating thin aluminum skins, such as that found on aircraft and aluminum boats. With conventional curing systems, the thin aluminum skin is powder coated with an electrostatic spray gun. The powder adheres to aluminum skin by electrostatic attraction. The electrostatic charge is typically weak and the powder can be dislodged from the surface with minimum effort. This is often a recurrent problem with thin aluminum skinned parts, as when heated conventionally they tend to "oilcan" due to rapid thermal expansion of the metal. This "oil canning" effect causes a rapid change in shape and motion, causing the weakly adhered powder coating to be ejected from the surface. This phenomenon is the cause of several rejects on the aforementioned aluminum part. The current laser coating system as described is capable of mitigating these problems on these aluminum surfaces. This is easily achieved by preheating the aluminum surface with sufficient laser energy to raise the temperature of the surface to about 55% of the upper melt limit temperature of the coating, prior to powder coating the aluminum surface. This added thermal energy causes the surface to expand and often "oilcan" prior to powder coating application. This also has several added benefits, the energy used to preheat is conserved, if the coating application is fully applied and cured on the surface immediately after. Another desirable benefit of laser preheating and curing thin aluminum parts, is that the paint is generally applied when the coated surface is expanded to near it maximum extent. This provides the coated surface with added durability as the coating contracts when cool and continued thermal and mechanical expansion of the coated aluminum surface remains stress and crack free longer. This benefit the coated surface as it avoids maximum mechanical stress of the coating at or above the flexure modulus of the coating.

Another benefit and a further objective of this invention, is the ability to place complex electrically conductive pathways within separate coating layers directly onto polymer coatings or other substrates. These coating pathways can have significant dimensional variations dependent on factors, such as current capability, voltage, and resistance. Typically these coatings are intralaminar or close to the near surface in order to facilitate protection from the environment. There are numerous applications for such a process.

In a normal application, a primer is applied to a metallic substrate. This primer acts as adhesion promoter, as well as an electrical insulator to separate the conductive pathways from other electrical elements. E.g., these conductive elements are encapsulated in between the primer coats and the top coat. There are many ways the conductive layer or layers may be applied. For example, highly conductive plastic polymers, such as Electraplast® EP-SS/PP, can be cryogenically ground to a fine powder, e.g. <160 μm, and mixed in a dispersion. The dispersion layer can be sprayed conventionally onto the substrate. Then, the operator of the laser system can choose to selectively fuse together the conductive coating and the substrate layer together so they can melt flow and adhere. The remaining uncured dispersion coating can be easily removed and recycled for future use. This method and this product provide highly conductive electrical trace with a high degree of accuracy and complexity. Electrical conductivity can exceed volume resistivity of 16 cm with additional additives, such as silver microspheres per ASTM D257. Additional conductive coating paths can be made with conductive inks and applied with a preprogrammed robotic inkjet printer. These specialized inkjet printers contain a plurality of specialized piezoelectric inkjet print heads, which is triggered by a programmed voltage pulse emitting well defined drops of inks in an XY direction over the substrate in a predetermined pattern and can be intermixed with other conductive materials of various resistance to produce electrical circuits of ever increasing complexity. These conductive materials and inks can be cured with UV or thermal radiation, as described above.

These electrical circuits can be over coated with a protective coating such as those described earlier in this text to provide an intra-laminar circuit similar to those found on electrical circuit boards. As a result of this invention and a subsequent use for this technology, a circuit path can be established on the inner liner of an aircraft turbine engine compressor with the conductive elements at our near the surface of the coating on the said inner liner of the High Pressure compressor surface.

The conductive elements are staggered in such a fashion to form separate conductive pathways of about 500 μm-1 mm wide and a plurality of them produced directly under the compressor rotor. The plurality formations of conductive elements (the cathodes) are positioned as to encompass the full width of the rotor blade at its tip but not so close to the turbine stator blade as to cause arching or high current flow. Subsequently, further down stream, a solid conductive layer is formed near or on the stator (the anode) these conductive pathways are positioned at each and every compression stage of the aircraft turbine engine. When the electrodes (cathodes) are energized in close proximity to each other with a high voltage electrical charge 10-70 Kv, a faraday cage is produced between each separate conductive element ("electrode"). The faraday cage can be varied in accordance with the down stream free flow air. These inventive step through the affect of the faraday cage substantially affect the air-flow about the tip of turbine engine compressor rotor. It is widely known that restricting airflow at and around the turbine rotor or the gaps between the turbine rotor and the spindle or frame will significantly improve the compressor efficiency, and therefore improve overall fuel efficiency. In fact thermally applied abradable powder coatings are often used to improve turbine engine compressor efficiency. The placement of the anode in the near proximity acts as a ground to the ionized air such that it will not adversely affect the down stream airflow in an uncontrolled fashion. This is only one inventive step and use of these applied conductive pathways.

Other conductive pathways may be used and energized over a linear path with segments of increased electrical resistance. This described electrical path when energized produces $I^2R$ losses, producing heat much the same way a rear window defroster produces heat on a car window. This process will produce the same results when produced in an intralaminar coating over an aircraft wing and can be utilized for deicing or anti-icing.

While the preferred embodiments have been shown and described, it will be understood that there is no intent to limit the invention by such disclosure, but rather, is intended to cover all modifications and alternate constructions falling within the spirit and scope of the invention.

What is claimed is:

1. A method of coating and curing a substrate with a coating or coating powder, including the steps of:

providing a microcontroller with a first program for subdividing the substrate into a plurality of target fields encompassing an entire surface of a portion of the substrate to be coated;

directing a beam of visible light at the substrate;

sensing the beam of visible light reflected from the substrate;

utilizing the program for subdividing the portion of the substrate to be coated into a plurality of target fields;

providing said microcontroller with a second program for controlling a closed loop system for altering a power density of a laser in real time producing a laser beam directed at a first target field responsive to a difference between a set temperature provided in the microcontroller, based upon a composition of the substrate and a composition of the coating or coating powder and a sensed temperature of said first target field;

applying the coating powder to the first target field, wherein during the application of the coating powder to the first target field, a thermal signature, an optical scattering signature and a footprint of a scanned portion of the first target field is monitored on a real time basis;

directing a first laser beam produced by the laser at the first target field to heat the first target field to a lower processing temperature of the coating powder, the first laser beam encompassing an entire area of the first target field, wherein the directing of the first laser beam and the second laser beam onto the first target field is controlled in real time, in a continuous closed servo loop, and not from a preselected program or menu;

combining a second laser beam produced by the laser beam with the first laser beam directed at the first target field to heat the first target field to an upper processing temperature of the coating or coating powder;

scanning the second laser beam across the first target field;

sensing a temperature of the first target field;

comparing the sensed temperature of the first target field with the set temperature;

altering the power density of one or both of the first and second laser beams when the sensed temperature differs from the set temperature by a predetermined amount, the step of altering the power density includes monitoring a rising temperature of the initial target field in real time through the application of a focal plane array including a long wave infrared monitoring system, as well as a wide field thermal imaging camera; and repeating a scan of the second laser beam across the first target field until the first target field has been completely coated with the coating or coating powder, thereby controlling a melt flow rheology and cross-link tapering at an edge of coated fields in order to ensure proper coating continuity and to prevent coating failure between adjacent fields the step of repeating a scan includes constantly measuring a thickness of the coating with a telemetry monitoring system and continuing until a predetermined thickness or shape is produced.

2. The method in accordance with claim 1, further including the step of directing each of the first laser beam and the second laser beam at each of the plurality of target fields until the entire surface of the substrate to be coated has been coated with the coating or coating powder.

3. The method in accordance with claim 1, wherein the first laser beam covers the entire area of the first target field, as well as impinging upon a portion of all target fields adjacent to the first target field, resulting in coated surfaces of each of the target fields adjacent to the first target field being cross-linked with one another, thereby forming a continuous coating over the entire surface of the portion of the substrate to be coated.

4. The method in accordance with claim 3, further including over-scanning the entire surface of the portion of the substrate to be coated.

5. The method in accordance with claim 4, wherein over-scanning the entire surface is accomplished by both the first laser beam and the second laser beam.

* * * * *